United States Patent [19]

Antoniazzi

[11] Patent Number: 4,820,487

[45] Date of Patent: Apr. 11, 1989

[54] GOLD ALLOY

[76] Inventor: Vittorio Antoniazzi, Avenida Alvear 1891 - 4th Floor, Buenos Aires

[21] Appl. No.: 173,253

[22] Filed: Mar. 24, 1988

Related U.S. Application Data

[63] Continuation-in-part of Ser. No. 116,483, Nov. 2, 1987, abandoned, which is a continuation-in-part of Ser. No. 924,192, Oct. 28, 1986, abandoned.

[30] Foreign Application Priority Data

Dec. 6, 1985 [AR] Argentina ..... 302493

[51] Int. Cl.[4] ..... C22C 5/02

[52] U.S. Cl. ..... 420/512; 63/2

[58] Field of Search ..... 420/512; 63/2

[56] References Cited

U.S. PATENT DOCUMENTS 3,846,125 11/1974 Stevens, Jr. ..... 420/512

FOREIGN PATENT DOCUMENTS 5833 1/1982 Japan ..... 420/512

*Primary Examiner*—L. Dewayne Rutledge
*Assistant Examiner*—Robert L. McDowell
*Attorney, Agent, or Firm*—Ladas & Parry

[57] ABSTRACT

This invention comprises a gold alloy comprising the following ingredients substantially in the following range by weight:

| | |
|---|---|
| (1) gold | 80 to 88% |
| (2) nickel | 3 to 6% |
| (3) chromium | 2 to 3% |
| (4) molybdenum | 0.1 to 0.4% |
| (5) vanadium | 1 to 3% |
| (6) carbon | 0.1 to 1.5% |
| (7) tungsten | 0.1 to 1.5% |
| (8) iron | 3 to 6% |

3 Claims, No Drawings

GOLD ALLOY

This is a continuation-in-part of application Ser. No. 07/116,483 filed Nov. 2, 1987, now abandoned, which is a continuation-in-part of application Ser. No. 924,192 filed Oct. 28, 1986, now abandoned.

The object of this invention is a gold alloy for use by jewelers and goldsmiths.

In the unending quest for jewels having ornamental characteristics that will attract the eventual buyer, modifications of the natural yellow color of gold, have been sought, thus creating different gold varieties with regard to color such as white gold, green gold, blue gold, etc.

In most cases these variations are alloys of gold with other base or precious metals, the proportions of which within the alloy are left to the creativity of the jeweler or goldsmith manufacturer of jewels.

A gold and iron alloy which has an exceedingly attractive peacock blue color is already known.

The invention relates to a new gold alloy formed by said metal, nickel, chromium, molybdenum, vanadium, carbon, tungsten and iron. This alloy in addition to possessing great hardness and resistance has a beautiful iridescent blue color that imparts an extremely attractive appearance to the jewels made therefrom.

The alloy of this invention comprises the following ingredients, by weight:

| | |
|---|---|
| (1) gold | 80 to 88% |
| (2) nickel | 3 to 6% |
| (3) chromium | 2 to 3% |
| (4) molybdenum | 0.1 to 0.4% |
| (5) vanadium | 1 to 3% |
| (6) carbon | 0.1 to 1.5% |
| (7) tungsten | 0.1 to 1.5% |
| (8) iron | 3 to 6% |

For the preparation of the alloy the atmosphere in which the work is carried out is at a temperature of 25° to 40°, preferably at a temperature of about 30°-40° C., most preferably at 30° C.

Preferably the vessel or container in which the reaction is carried out is a crucible of common refractory material.

The crucible is pre-heated to a red-hot state in, for example, an oven made of refractory material heated with compressed air or natural gas (but not methane). The crucible is heated with a flux specially prepared with borax and sodium carbonate. Thereafter, in carrying out the process the gold is melted in the crucible, this taking place at a temperature of about 1400°-1500° C.

Then the remaining components of the alloy are added to the melted gold such that a homogenous mixture is obtained. The mixture is then poured into a mold and allowed to cool at 25°-30° C. (room temperature) for about 30-40 minutes without using water. Once cold the alloy is treated with about a liter of a solution of sulfuric acid and cold water (preferably 10% sulfuric acid).

There is thus obtained a gold alloy bar of a beautiful iridescent blue color. The shade of color obtained depends on the time and temperature at which the metal piece is left. Lighter colors are obtained when the temperature is brought down and darker colors when the temperature is brought up.

It is evident that for the manufacture of jewels using this alloy, the molten mass thereof will be poured in adequate molds where the above mentioned finishing treatment will be applied, then carrying out the customary operation for finishing the jewel.

The properties of the gold are illustrated in the below indicated examples:

EXAMPLE I

Superficial examination after exposure to a chamber of saline mist provided no alteration in the *sample after 72 hours.

EXAMPLE II

Metallographic analysis of the *samples as to the Grain size (assay 5/ASTM/E112) provided a number of 8. The structure of the grain after microscopic analysis 200× showed polygonal grains, approximately homogenous.

The hardness ** of gold sample 1 was 104-114 (HV500 gr).

The hardness of sample 2 was 121-129.

The hardness of sample 3 was 126-140.

The hardness indicated is Vicker's hardness, also known as Diamond Pyramid Hardness. Hardness is equal to load (kg) divided by surface area (sq. mm) of the permanent indentation. It is determined directly from optical measurements of the diagonals of the indentations which appear square in the surface of the metal.

EXAMPLE III

Metallographic analysis of the gold provided the following parameters.

| | Sample 1 | Sample 2 |
|---|---|---|
| Initial section ($mm^2$) | 5./50 | 4./23 |
| Breaking tension ($N/mm^2$) | 450./18 | 442./78 |
| Flowing tension ($N/mm^2$) | 252./36 | 304/.72 |
| Initial length (mm) | 13./00 | 11/.00 |
| Elongation (%) | 39./00 | 31/.36 |

*The samples in Examples I-III have the composition:

| | |
|---|---|
| gold | 84.5% |
| nickel | 5.20% |
| chromium | 2.20% |
| molybdenum | .10% |
| vanadium | 2.50% |
| carbon | .40% |
| tungsten | .10% |
| iron | 5% |

** The differences in hardness values is attributable to differing assay conditions. The temperature of 850° C. was used exclusively for hardness values, and thermal treatment performed under $N_2$. The samples, however were cooled differently. Sample 1 was cooled in an oven, sample 2 was cooled in air and sample 3 cooled in water.

There is thus obtained a gold alloy bar of a beautiful iridescent blue color. The shade of color obtained depends on the time and temperature at which the metal piece is left. Lighter colors are obtained when the temperature is brought down and darker colors when the temperature is brought up.

It is evident that for the manufacture of jewels using this alloy, the molten mass thereof will be poured in adequate molds where the above mentioned finishing treatment will be applied, then carrying out the customary operation for finishing the jewel.

I claim:

1. A gold alloy comprising the following ingredients, by weight:

| | |
|---|---|
| (1) gold | 80 to 88% |
| (2) nickel | 3 to 6% |
| (3) chromium | 2 to 3% |
| (4) molybdenum | 0.1 to 0.4% |
| (5) vanadium | 1 to 3% |
| (6) carbon | 0.1 to 1.5% |
| (7) tungsten | 0.1 to 1.5% |

-continued

| | |
|---|---|
| (8) iron | 3 to 6% |

2. A gold alloy according to claim 1, comprising the following

| | |
|---|---|
| nickel | 5.20% |
| chromium | 2.20% |
| molybdenum | 0.10% |
| vanadium | 2.50% |
| carbon | 0.40% |
| tungsten | 0.10% |
| iron | 5% |

3. A gold alloy according to claim 1 comprising a Vickers hardness of 104–140.

* * * * *